US009316466B2

(12) United States Patent
Obyle et al.

(10) Patent No.: US 9,316,466 B2
(45) Date of Patent: Apr. 19, 2016

(54) DRIVER'S HATCH

(71) Applicant: BAE Systems Land & Armaments, L.P., Santa Clara, CA (US)

(72) Inventors: Shawn J. Obyle, York, PA (US); Daniel T. Myers, Taneytown, MA (US); David W. White, Rochester Hills, MI (US); Dana K. Grier, York, PA (US)

(73) Assignee: BAE Systems Land & Armaments, L.P., Santa Clara, CA (US)

( * ) Notice: Subject to any disclaimer, the term of this patent is extended or adjusted under 35 U.S.C. 154(b) by 0 days.

(21) Appl. No.: 14/206,795

(22) Filed: Mar. 12, 2014

(65) Prior Publication Data

US 2014/0260940 A1 Sep. 18, 2014

Related U.S. Application Data

(60) Provisional application No. 61/777,863, filed on Mar. 12, 2013.

(51) Int. Cl.
*F41H 5/22* (2006.01)
*F41H 7/02* (2006.01)

(52) U.S. Cl.
CPC ..... *F41H 5/223* (2013.01)

(58) Field of Classification Search
CPC ..... F41H 7/00; F41H 7/02; F41H 5/14; F41H 5/22; F41H 5/223; F41H 5/226
USPC ..... 89/36.01–36.17, 929, 931, 935
See application file for complete search history.

(56) References Cited

U.S. PATENT DOCUMENTS

| | | | | | |
|---|---|---|---|---|---|
| 2,436,374 | A * | 2/1948 | Birdsall | 296/152 |
| 2,454,268 | A * | 11/1948 | Brackett | 89/36.14 |
| 3,724,323 | A * | 4/1973 | Selle | 89/36.14 |
| 4,004,494 | A * | 1/1977 | Mechulam et al. | 89/36.14 |
| 4,646,616 | A * | 3/1987 | Svensson | 89/36.14 |
| 4,678,224 | A * | 7/1987 | F'Geppert | 296/91 |
| 4,934,246 | A * | 6/1990 | Benson et al. | 89/36.14 |
| 5,128,803 | A * | 7/1992 | Sprafke | 359/403 |
| 5,220,127 | A * | 6/1993 | Tiomkin et al. | 89/36.14 |
| 6,886,447 | B2 * | 5/2005 | Crotty et al. | 89/36.14 |
| 7,832,325 | B1 * | 11/2010 | Hamann | 89/36.13 |
| 8,146,476 | B2 * | 4/2012 | Schneider et al. | 89/36.08 |

(Continued)

FOREIGN PATENT DOCUMENTS

| | | |
|---|---|---|
| EP | 0859211 | 8/1998 |
| EP | 1059504 | 12/2000 |

(Continued)

OTHER PUBLICATIONS

International Search Report and Written Opinion from related PCT Application PCT/US2014/024792, dated Oct. 29, 2014, 9 pgs.
International Preliminary Report on Patentability from PCT Application PCT/US2014/024792, dated Sep. 24, 2015, 11 pgs.

*Primary Examiner* — Jonathan C Weber
(74) *Attorney, Agent, or Firm* — Patterson Thuente Pedersen, P.A.

(57) ABSTRACT

The present invention is a driver's hatch for an armored vehicle. The hatch includes a dome hatch for normal operations and a pop-up section. The pop-up section, when in the lowered position allows the cab to freely rotate above it. When in the raised position, the pop-up section allows the driver to look out of the vehicle through transparent armor windows and thus remain under armor protection.

13 Claims, 10 Drawing Sheets

(56) References Cited

U.S. PATENT DOCUMENTS

| | | | | |
|---|---|---|---|---|
| 8,356,541 | B2 * | 1/2013 | Schneider et al. | 89/36.08 |
| 2004/0237764 | A1 * | 12/2004 | Crotty et al. | 89/36.08 |
| 2011/0126697 | A1 * | 6/2011 | Schneider et al. | 89/36.08 |
| 2013/0000473 | A1 * | 1/2013 | Schvartz et al. | 89/33.2 |
| 2013/0220109 | A1 * | 8/2013 | Berkovich et al. | 89/36.13 |

FOREIGN PATENT DOCUMENTS

| | | |
|---|---|---|
| EP | 1361409 | 11/2003 |
| JP | 09290643 | 11/1997 |
| JP | 2005030683 | 2/2005 |

* cited by examiner

DRIVER'S HATCH

RELATED APPLICATION

The present application claims the benefit of U.S. Provisional Application No. 61/777,863 entitled "DRIVER'S HATCH", filed Mar. 12, 2013, which is incorporated herein by reference in its entirety.

FIELD OF THE INVENTION

The present invention is generally directed to the design of a hatch for an armored vehicle. More specifically, the current design involves a driver's hatch that includes a pop-up feature having a domed hatch that can be rotated from an open to a closed position as well as a selectively operably pop-up section that maybe attached to the hatch. The pop-up section includes transparent armored ports to protect the driver.

BACKGROUND OF THE INVENTION

Hatches provide access to a generally sealed environment such as areas of a military vehicle. Such hatches must be constructed to meet the same structural requirements as the surrounding structure. Furthermore, the hatch must maintain the integrity of the sealed environment when locked down.

The structural and weight requirements for a hatch frequently make them difficult to open. One of the main purposes of a hatch is to facilitate the movement of military personal, while providing the same level of protection as the rest of the vehicle structure. Depending upon the vehicle or embodiment, any particular hatch may include armor. Additional "top-attack" armor is commonly used to enhance protection when a vehicle is within a particularly high threat area. These survivability requirements drastically increase the weight of the hatch adding to the difficulty of operating the hatch.

With respect to armored vehicles, the driver's hatch has distinct requirements for operational performance as well as survivability. The driver must be able to have clear visibility to drive the armored vehicle. In many situations the driver will choose to have his head extend outside the hatch frame. In combat operations, however, the driver needs protection, and that requires a hatch that shields the driver.

Thus there is a need for a hatch that allows for operational performance and survivability. A hatch should be relatively easy to function, while remaining reliable. In a military vehicle, reliability must be maintained through rigorous and damaging conditions. The hatch of a military vehicle should accommodate the addition of armor. The steps needed to open and close the hatch portal should be minimal, taking into consideration the amount of force and time needed to operate the hatch during emergencies. Further, there is a need in armored vehicles for a hatch that allows the driver to remain protected while still performing the required mission.

SUMMARY OF THE INVENTION

The present invention includes a hatch assembly with a pop-up feature where the entire assembly can raise or lower to permit the driver more headroom. The design further includes a sight glass section which selectively attaches to the dome hatch.

In an embodiment, the driver's hatch assembly includes a dome hatch connected by a dome hatch hinge to a mount on the pop-up section. The dome hatch may have one or more latches internally disposed and a torsion bar to control/assist in operation of the dome hatch. The pop-up section is disposed within a frame element attached to the armored vehicle. The pop-up section is connected to the frame element by a pop-up section hinge. Thus the pop-up section is disposed between the dome hatch and the vehicle. The pop-up section further includes a plurality of transparent armor windows disposed so as to provide driver visibility in a generally forward [toward the vehicle's front end] direction. It is envisioned that the pop-up section rotates from the hinges. Rotation of the pop-up section maybe done manually or assisted by an electronic hydraulic actuator. The pop-up section may also have a latch, internally disposed, so as to maintain the pop-up section within the frame while opening the domed hatch. Thus the driver may chose to raise the dome hatch with or without the pop up section.

It envisioned that the present invention may incorporate the following embodiments separately or in combinations:

- The Driver's Hatch provides a head height clearance of 42" in accordance with MIL-STD-1472 when driving under protection.
- The Driver's Hatch provides T2 level protection when driving under protection and fire position.
- The Driver's Hatch provides an intermediate opening to provide protection from above when the dome is open.
- The Driver's Hatch remains clear of the cab and gun rotational space when the dome hatch and transparent armor are closed.
- The Driver's Hatch meets all head height clearance requirements when the driver's seat is installed with 5" of clearance from the floor.
- The Driver's Hatch can be able to be opened from the inside.
- The Driver's Hatch can be able to be opened from the outside.
- The Driver's Hatch may be closed to the fire position in under 10 seconds.
- The Driver's Hatch is compatible with a driver's night vision system when the transparent armor is deployed and the dome hatch is closed.
- The Driver's Hatch allows situational awareness in the forward direction using the driver's vision enhancement when in fire position.
- The Driver's Hatch apparatus may protrude into the cab and gun rotational space when the vehicle is moving.
- The Driver's Hatch remains sealed from water intrusion when the dome hatch and transparent armor are closed.
- The Driver's Hatch remains sealed from water intrusion when the transparent armor is deployed and the dome hatch is closed.
- An open warning light is provided to the Commander when the dome hatch is open or transparent armor is deployed.

The present invention is a driver's hatch for an armored vehicle. The driver's hatch including a pop-up section. The pop-up section is able to rotate from a retracted position to an up position wherein a plurality of transparent armor windows are exposed. The transparent armor windows are arranged about the leading edge of the pop-up section to allow a field of view for the driver. The pop-up section includes a seal element that seals the interior of the armored vehicle from the environment whether the pop-up section is retracted or in the up position. The driver's hatch includes a lift assist mechanism that rotates and lowers the pop-up section. The pop-up section also includes a latch that locks the pop-up section into the retracted or up position. The driver's hatch further including a dome hatch, said dome hatch mounted by a hinge to a top plate of the pop-up section.

The present invention is a driver's hatch for an armored vehicle that includes a dome hatch, a pop-up section that supports the dome hatch, and a bolt-on plate that mounts to the armored vehicle, said bolt-on plate defining an aperture in which the pop-up section is disposed. An emergency hatch maybe disposed within the dome hatch aperture, said emergency hatch restrained in the dome hatch aperture by a plurality of locking pins.

The dome hatch is connected to a top plate of the pop-up section by a hinge. The dome hatch is raised by operating a dome hatch latch. The dome hatch latch further includes an indexing pin control so as to lock the dome hatch in a plurality of various preset positions.

In operation, a leading edge of the pop-up section rotates away from the bolt-on plate through pop-up section hinge. A pop-up section lift mechanism is used to rotate the pop-up section. The lift mechanism may be an electric hydraulic actuator, an electric worm gear or a manually operated jack.

The pop-up section has a trapezoidal shape and contains a plurality of transparent armored windows disposed about the leading edge of the pop-up section. In a first embodiment there are three transparent armored windows and two triangular wall pieces that create the outline of the pop-up section. Each transparent armored window is sealed into a transparent armored frame element. The pop-up section is sealed to the bolt-on plate by a flexible sealing ring. The pop-up section also includes a latch for locking the pop-up section in a retracted position or up position.

The present invention is also a method for positioning a driver's hatch, the driver's hatch including a pop-up section. The method comprising: unlatching a pop-up section latch, said pop-up section latch selectively fixing the pop-up section relative to a bolt-on plate attached a vehicle; activating a lift assist mechanism that rotates and lowers the pop-up section relative to the bolt-on plate to a retracted or an up position; and latching the pop-up section latch upon achieving a desired position for the pop-up section. The pop-up section including a seal element that seals the interior of the vehicle from the environment whether the pop-up section is retracted or in the up position.

The method further including the step of verifying that no obstructions are in the path of the pop-up section.

The method further including the step of notifying the operator of the position of the pop-up section, said pop-up section including a pop-up section location sensor The above summary of the various representative embodiments of the invention is not intended to describe each illustrated embodiment or every implementation of the invention. Rather, the embodiments are chosen and described so that others skilled in the art can appreciate and understand the principles and practices of the invention. The figures in the detailed description that follow more particularly exemplify these embodiments.

BRIEF DESCRIPTION OF THE DRAWINGS

The invention can be completely understood in consideration of the following detailed description of various embodiments of the invention in connection with the accompanying drawings, in which.

Figure 1:
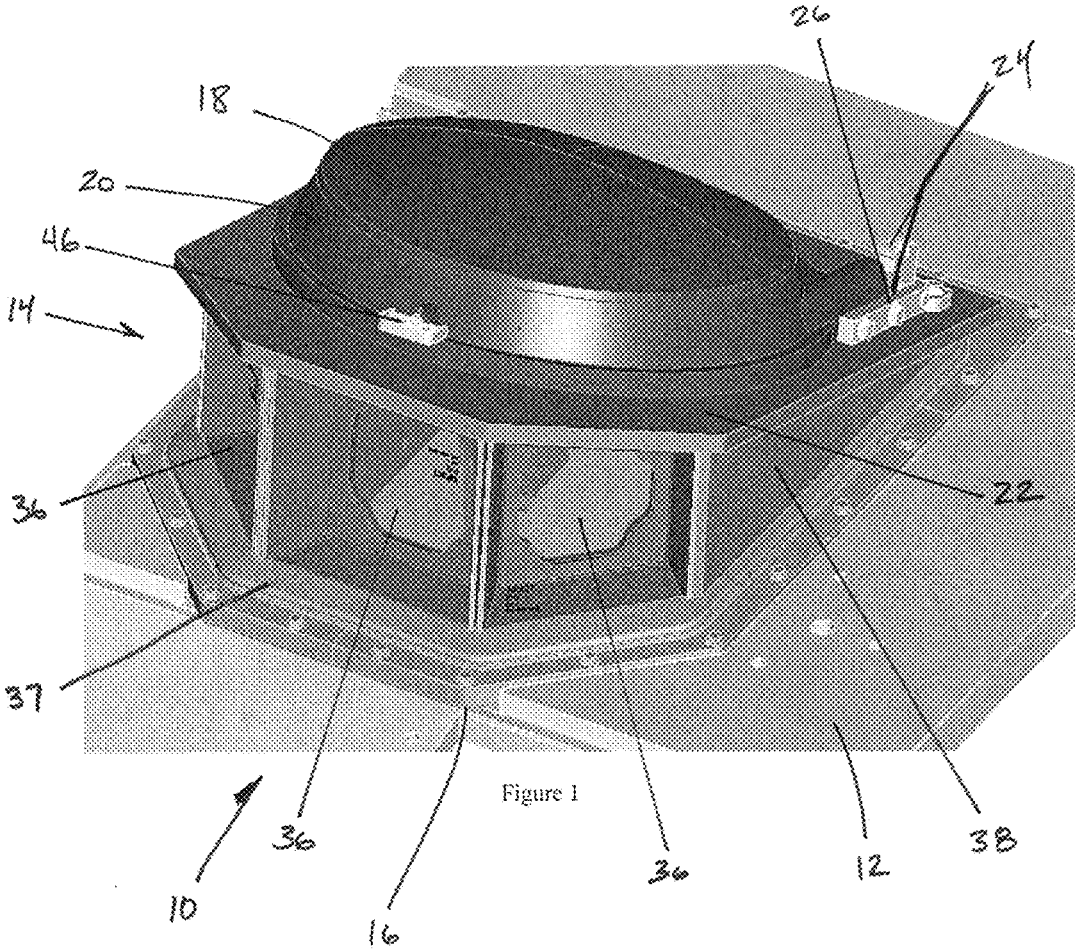
FIG. 1 is a perspective view of the first embodiment of the present invention with the pop-up section.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION OF THE DRAWINGS

FIGS. 1-16 depict a first embodiment of the present invention. The present invention includes a hatch assembly 10 for an armored vehicle 12 with a pop-up section 14. The pop-up section 14 can be raised or lowered to permit the driver more headroom.

Figure 2:
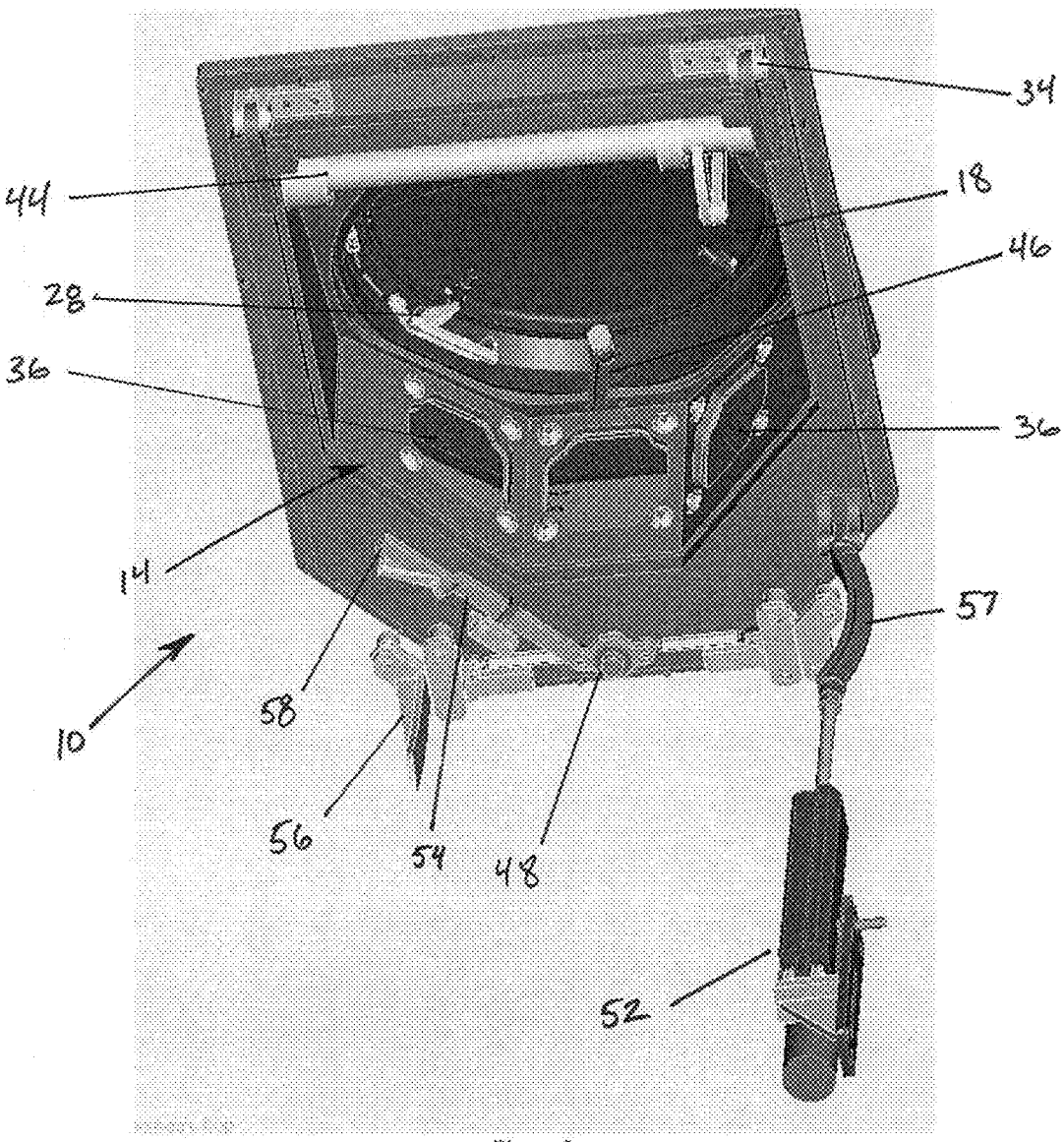
FIG. 2 is a perspective view of the first embodiment of the present invention from inside of a vehicle with the pop-up section raised.
Figure 3:
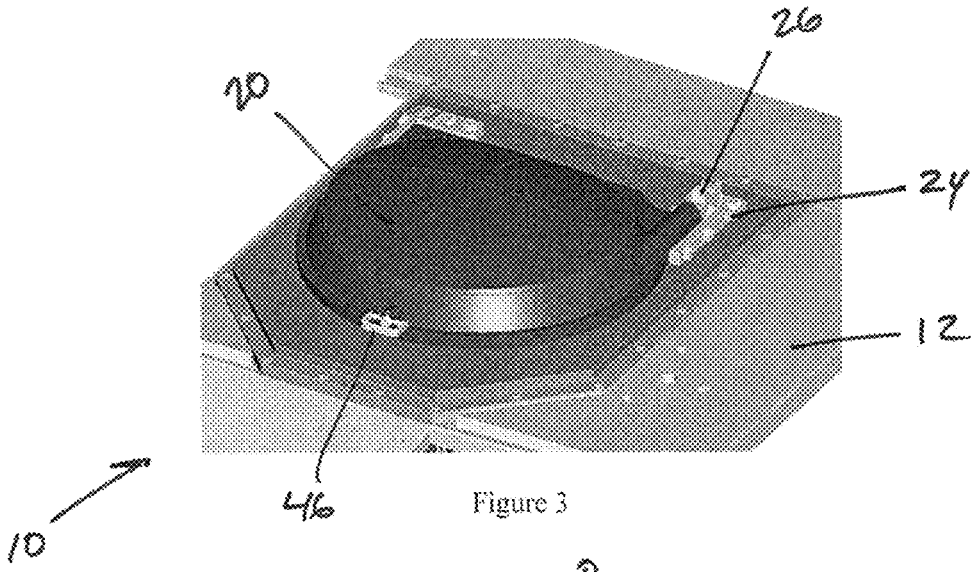
FIG. 3 is a perspective view of the first embodiment of the present invention with the pop-up section retracted.
Figure 4:
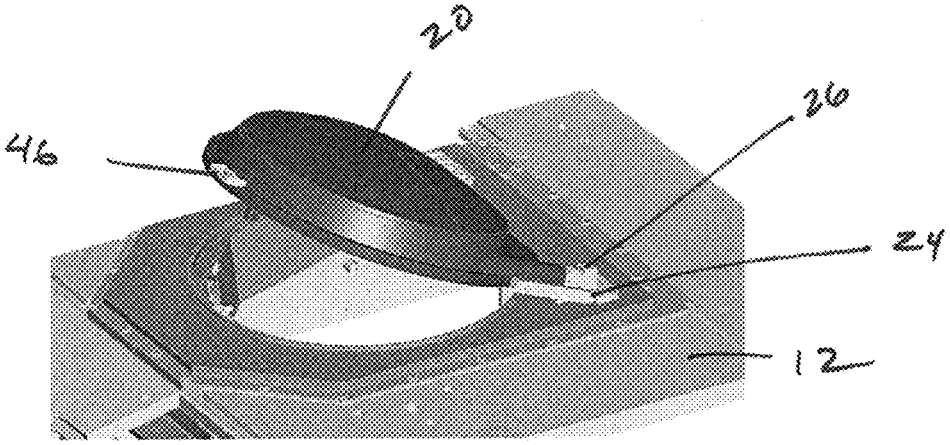
FIG. 4 is a perspective view of the first embodiment of the present invention with the dome hatch partially raised.

As illustrated in FIGS. 1-2, the hatch assembly 10 is disposed within an armored vehicle 12. The hatch assembly 10 is mounted to the vehicle 10 at bolt-on plate 16. Bolt-on plate 16 provides the base frame for hatch assembly 10.

Hatch assembly 10 includes an emergency hatch 18 disposed within dome hatch 20. Dome hatch 20 is mounted to pop-up hatch top plate 22 at dome hatch hinge 24. The dome hatch 20 is rotatable about the dome hatch hinge 24 from a perpendicular position to a vertical position or beyond vertical depending on the geometry of the armored vehicle 10 and its armament. The dome hatch 20 maybe locked into various setting by dome hatch index block 26. The dome hatch index block 26, disposed on pop-up hatch plate 22, mates with dome hatch index latch 28 which is mounted on the interior face of dome hatch 20. The dome hatch index latch 28 selectively activates dome hatch index pin 30. An operator 11 can thus open dome hatch 20 and lock the dome hatch 20 into a preset orientation by driving the dome hatch index pin 30 into grooves 32 in the dome hatch index block 26. For example, dome hatch 20 may include the following positions:

Fire Position Solution
  Closed Dome Hatch
Driving Partially Out Position Solution
  Dome Hatch at 25 degrees open
Driving Out Position Solution
  Dome Hatch at 70 degrees open
Ingress/Egress Position Solution
  Dome Hatch at 95 degrees open
  No hard indexing locking for this position Due to the weight caused by the armor, dome hatch 20 may include a dome hatch torsion bar 44 to assist the operator in raising and lowering the dome hatch 20. Due to weight issues the dome hatch may require assistance for raising and lowering. The assist mechanism may either be a torsion bar 44 with linkage or a counterbalance system with a cam. The dome hatch 20 further includes a dome hatch latch 46, disposed at the opposing end of dome hatch 20 from dome hatch hinge 24.

Pop-up section 14 generally includes pop-up hatch plate 22, pop-up section hinge 34, transparent armor panels 36, armored side panels 38, and pop-up section base plate 40. The pop-up section 14 has a generally trapezoidal shape. The base 42 of pop-up section 14 is attached to bolt-on plate 16 through pop-up section hinges 34. Pop-up section 14 is then rotatable from a position flush with bolt-on plate 16 to an elevated position where the transparent armor panels 36 are extending from the bolt-on plate 16.

The pop-up section 14 is operated through a pop-up section latch 48 and pop-up lifting and locking system 50. The pop-up section 14 lifting and locking system 50 may include an Electric Hydraulic Actuator (EHA) 52 operably connected to pop-up section lift arm 57. The EHA 52 would preferably be sized at 35 amps@24 VDC. The actuator control switch 54 may be placed on the locking handle 54 and the Pop-Up Section closed sensor 56 placed on the latch 48.

In operation, raising the pop-up section 14 would require an operator to unlatch the pop-up section 14 through pop-up section latch 48. Pop-up section latch 48 may include a release handle 49. Once unlatched, the operator would activate the actuator control 58 operably connected to EHA 52. Preferably, actuator control 58 is mounted on pop-up latch 48. Actuator control 58 maybe a toggle switch 59 wherein pushing up raises the pop-up hatch, lowering toggle 59 lowers the pop-up hatch and the neutral position for toggle 59 turns off the EHA 52.

In the case of an emergency power outage, a hand pump will be used to raise the pop-up section 14. The hand pump mechanism can be located in various places within the vehicle and attached as needed.

Hatch assembly 10 includes an emergency hatch 18 disposed within dome hatch 20. Emergency hatch 18 rests on dome hatch flange 60. It is envisioned that a seal will be placed between dome hatch flange 60 and emergency hatch 18. Emergency hatch 18 is held in place by a plurality of pins 62 that extend into dome hatch 20. The emergency hatch 18, in one embodiment, is a 100 lb removable section, sealed with a rubber O ring and held in place by four 0.375" diameter pins. When the emergency hatch 18 is removed the dome hatch 20 frame remains.

Figure 12:
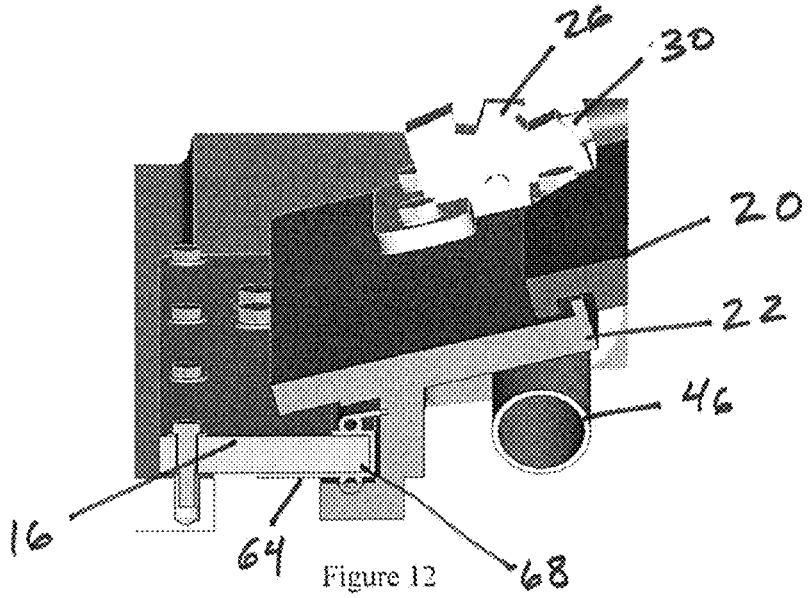
FIG. 12 is a cross sectional view of an embodiment of a seal for the present invention at the pop-up hinge.
Figure 13:
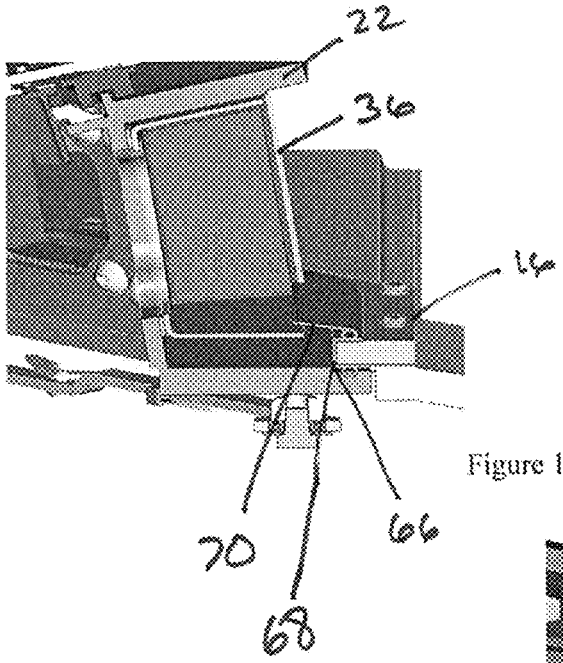
FIG. 13 is a cross sectional view of an embodiment of a seal for the present invention at the base of the transparent armor.
Figure 14:
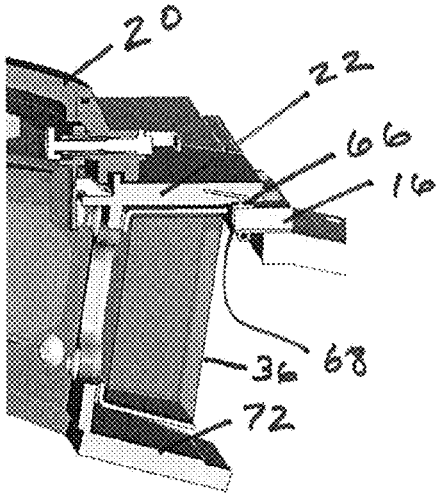
FIG. 14 is a cross sectional view of an embodiment of a seal for the present invention when the pop-up section is elevated.
Figure 15:
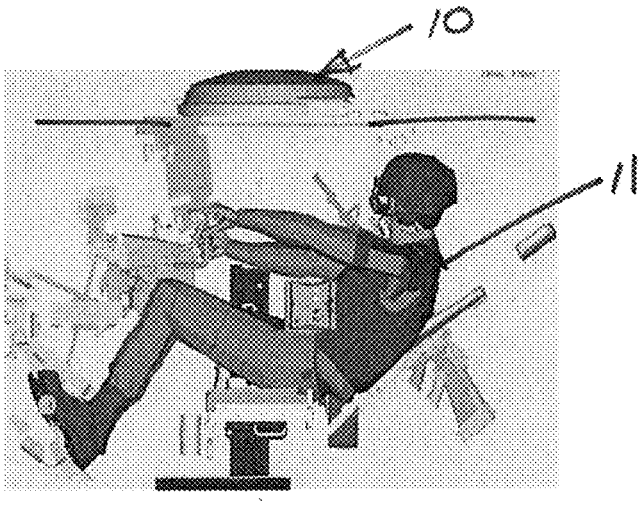
FIG. 15 is a perspective view of the present invention showing the operator's position.
Figure 16:
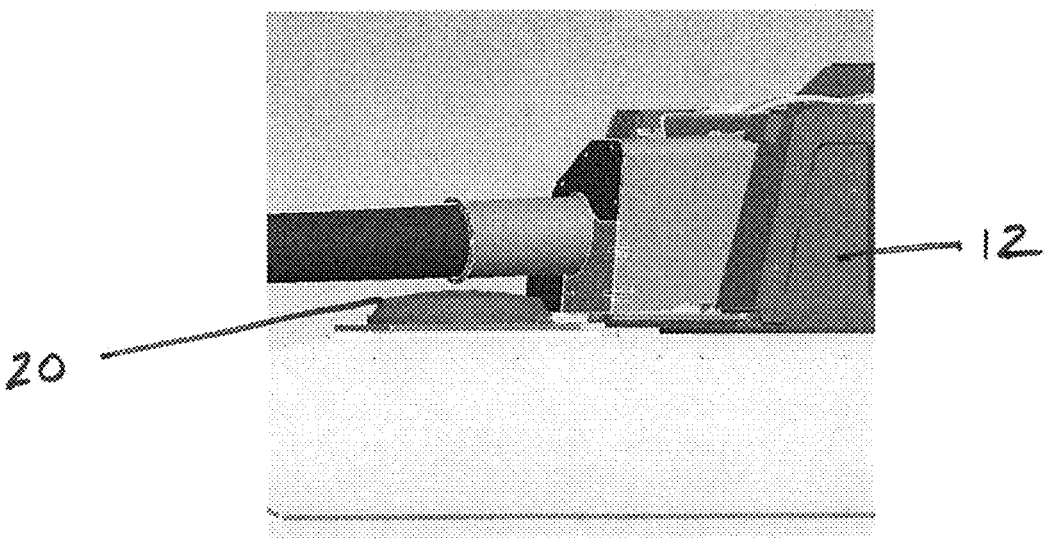
FIG. 16 is a perspective view of the present invention view as mounted on a vehicle.

It is very important that the interior of the vehicle be kept free of contaminants. The hatch assembly 10 should include seals to maintain air quality through all phases of operation. FIGS. 12-14 illustrate the seal system. FIG. 12 depicts a cross sectional view of the hinge seal 64 at the pop-up section hinge 34. Hinge seal 64 wraps around the inner margin 68 of the bolt-on plate 16.

Figure 5:
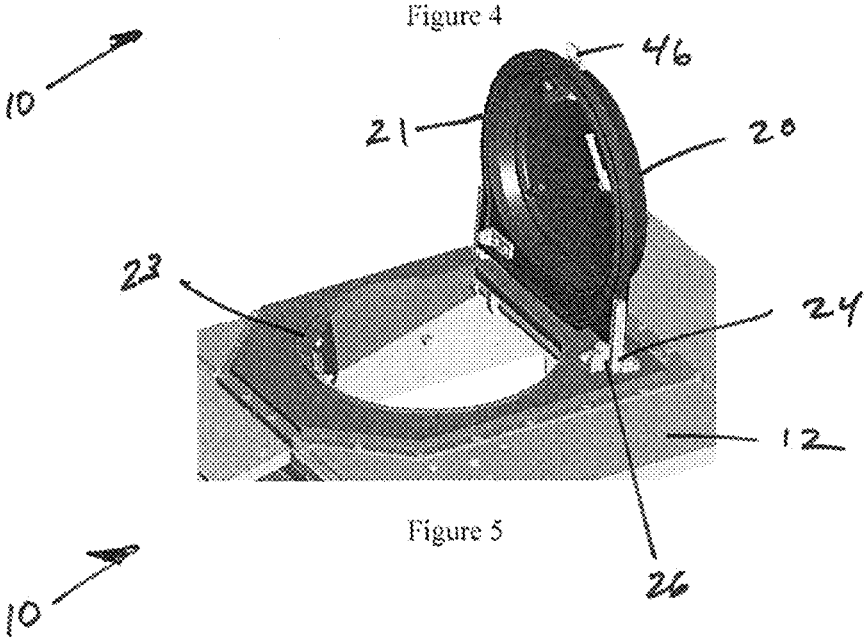
FIG. 5 is a perspective view of the first embodiment of the present invention with the dome hatch raised to the vertical setting
Figure 6:
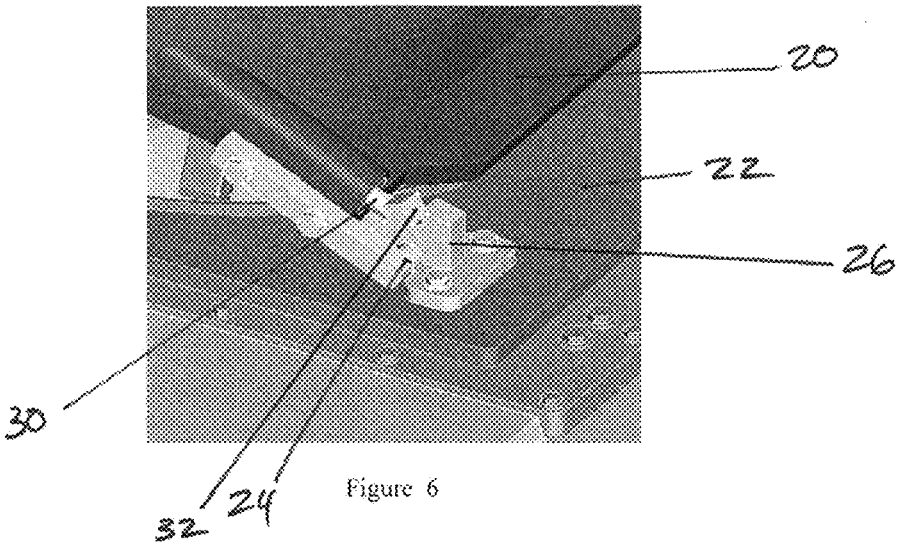
FIG. 6 is a perspective view of the dome hatch hinge and indexing block of the first embodiment of the present invention.
Figure 7:
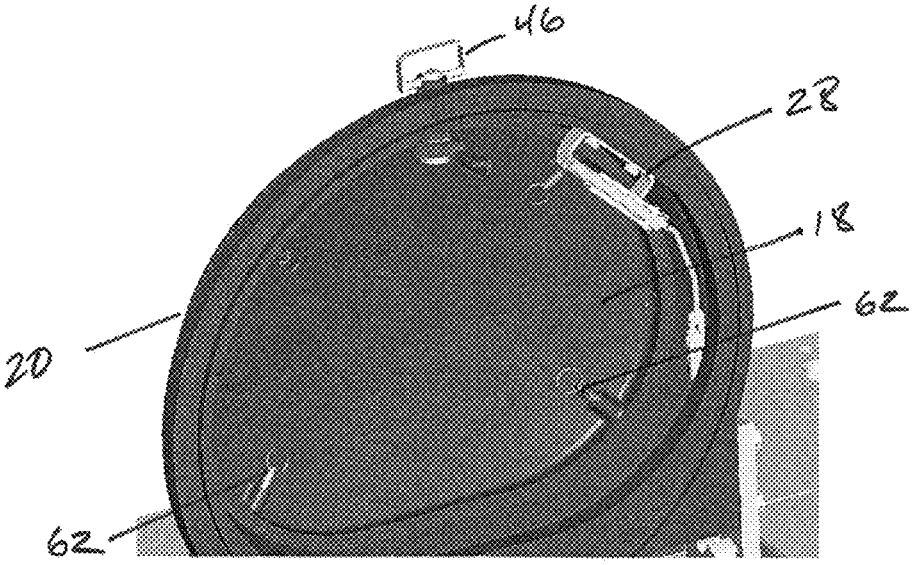
FIG. 7 is a perspective view of the inner face of the dome hatch in an open position.
Figure 8:
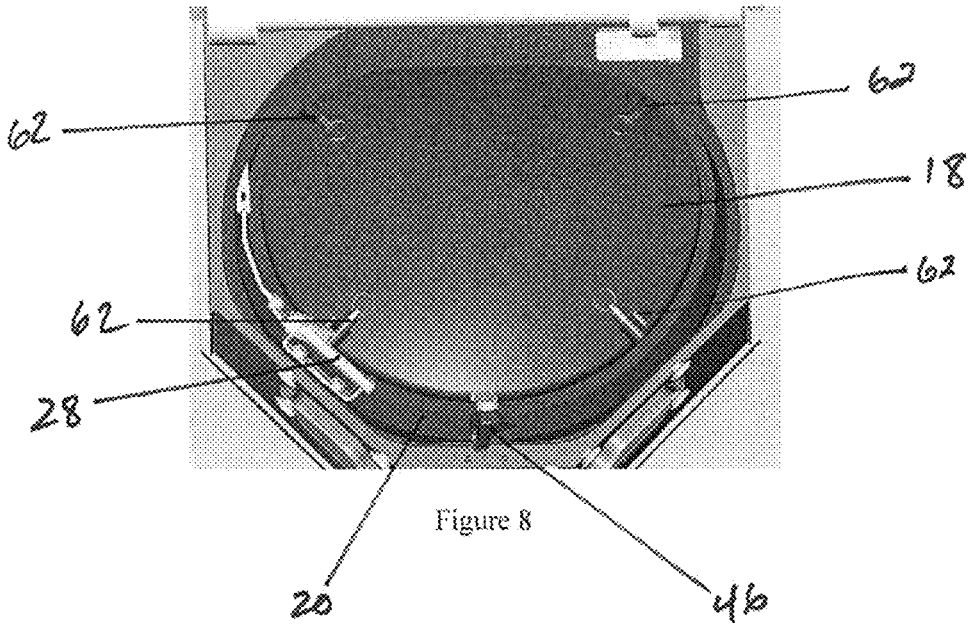
FIG. 8 is a perspective view of the inner face of the dome hatch in a closed position.
Figure 9:
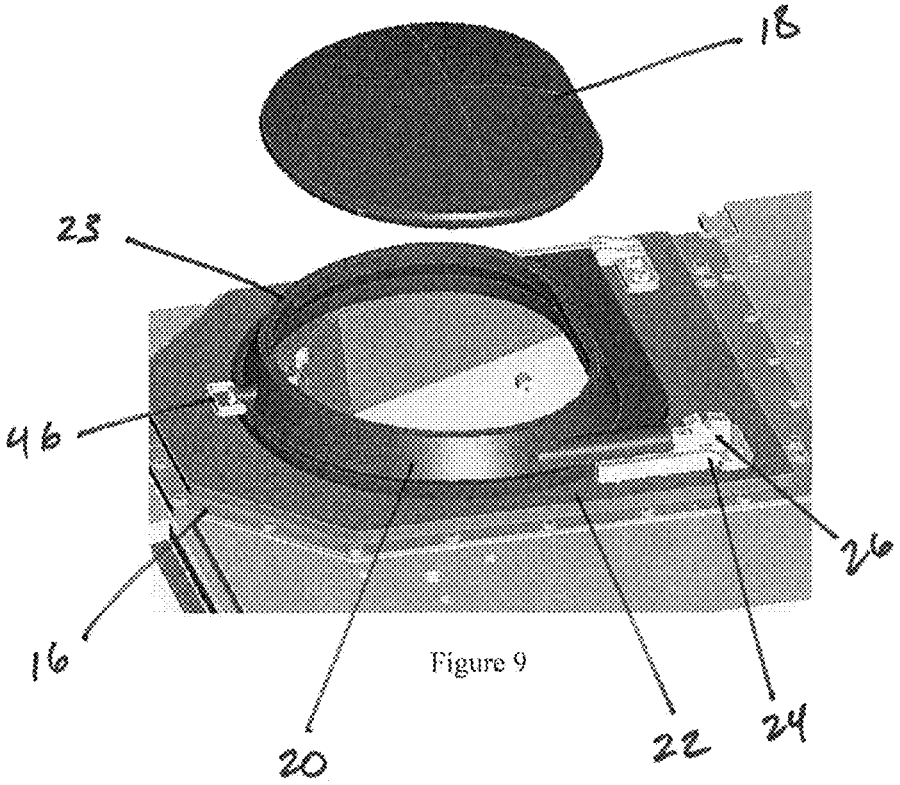
FIG. 9 is a perspective view of the first embodiment of the present invention with the emergency cap to the dome hatch removed.
Figure 10:
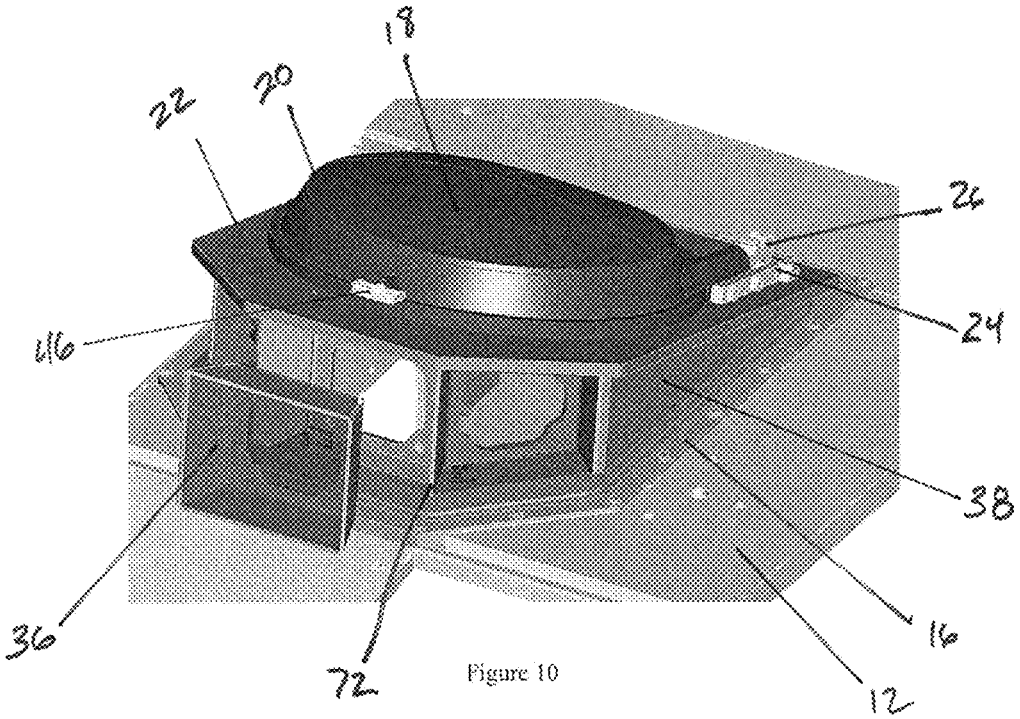
FIG. 10 is a perspective view of the ballistic glass assembly of the pop-up section.
Figure 11:
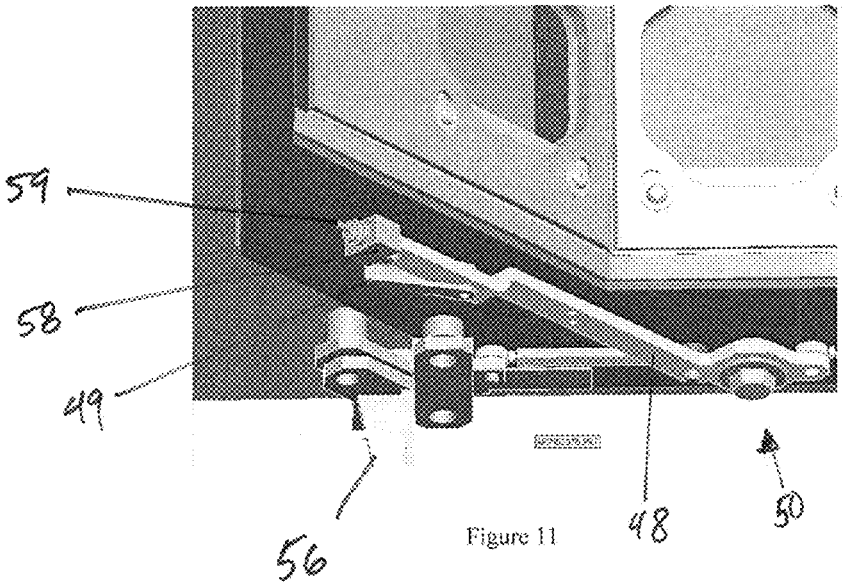
FIG. 11 is a perspective view of the pop-up section actuator control switch.

As illustrated in FIG. 5, the dome hatch 20 rotates from the pop-up section 14. It is envisioned that the dome hatch 20 includes a seal groove 21 that operably mates with a raised plate edge 23 on the pop-up section top plate 22.

FIGS. 13-14 depicts the position of the bolt-on plate seal 66. Bolt-on seal 66 wraps around inner margin 68 of bolt-on plate 16. Bolt-on seal 66 further includes flange 70 that seals the driver's compartment when pop-up section 14 is raised. It is envisioned that seal 66 for the Pop-Up section 14 may include an all-in-one molded seal around the Bolt-On plate 16. The bolt-on plate 16 may be made of a monolithic piece or multiple pieces. There may be seals connecting the Bolt-On plate to the hull; seals on the Pop-Up bottom plate to Bolt-On plate and seals for the Pop-Up top plate to Bolt-On plate. Other options may include a bristle seal.

In an alternate embodiment, the transparent armor windows 36 are disposed within the leading edge face 37 of the pop-up section 14. The transparent armor windows 36 may slide in a frame 72 within the pop-up section 14. The ballistic glass for the transparent armor windows 36 may be preferably 3.5" thick with the center window opening 6.75" wide by 6.4" high. The glass will be installed from the front with attaching hardware coming from the driver's compartment.

Figure 17:
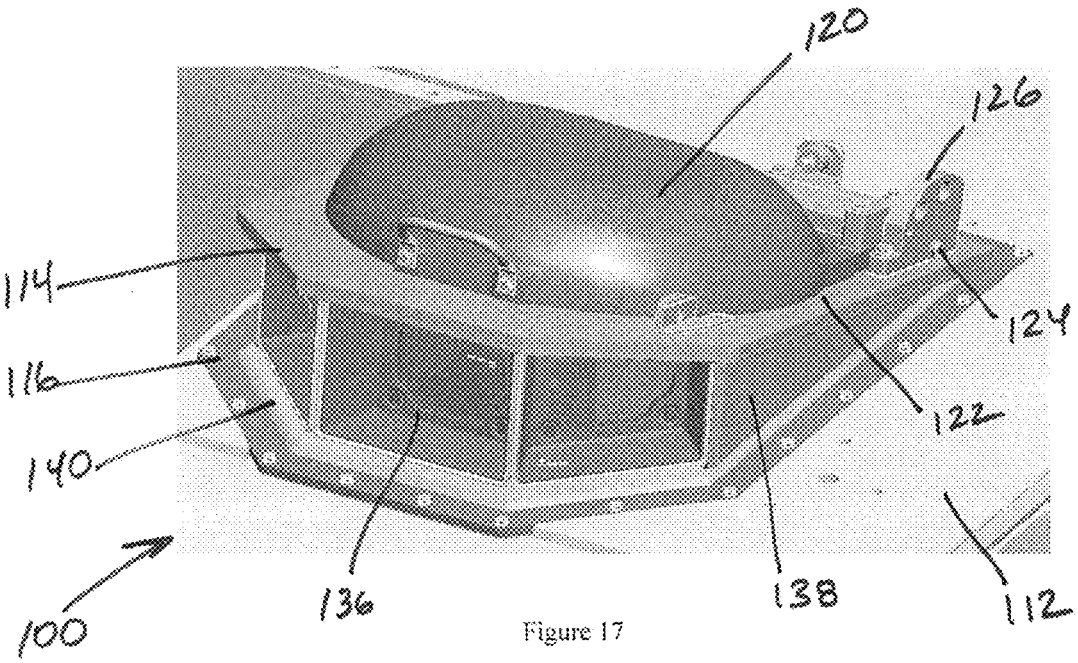
FIG. 17 is an alternate embodiment of the present invention with the pop-up section elevated.
Figure 18:
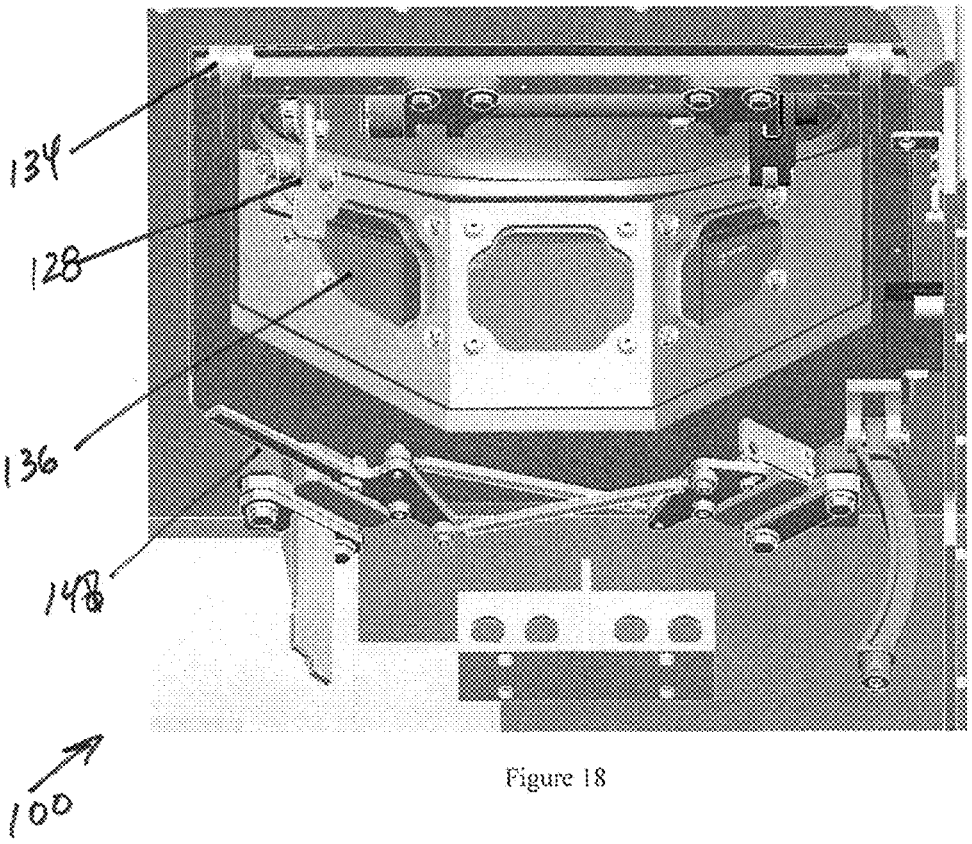
FIG. 18 is an interior perspective view of the embodiment of FIG. 17.
Figure 19:
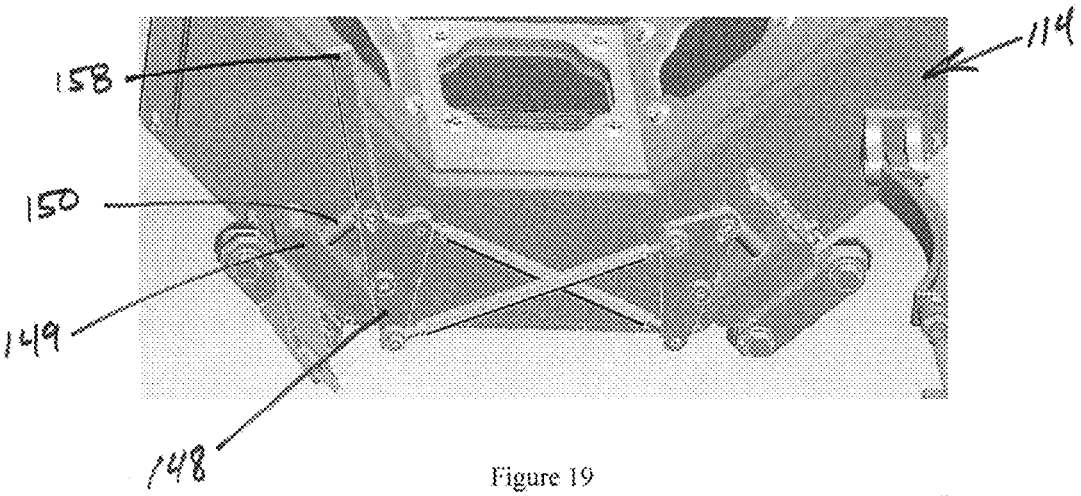
FIG. 19 is an interior perspective view of the embodiment of FIG. 18 with the pop-up section latch in the open position.

In an alternate embodiment, as illustrated in FIGS. 17-19, hatch assembly 100 includes a dome hatch 120 without an emergency hatch. Dome hatch 120 is mounted to pop-up hatch top plate 122 at dome hatch hinge 124. The dome hatch 120 is rotatable about the dome hatch hinge 124 from a perpendicular position to a vertical position or beyond vertical depending on the geometry of the armored vehicle 112 and its armament. The dome hatch 120 maybe locked into various setting by the spring loaded dome latch 128 that mates with dome hatch index apertures 126. The dome hatch index apertures 126, disposed on pop-up hatch plate 122, mates with a dome hatch index pin which is controlled on the interior face of dome hatch 120 by dome latch 128.

Pop-up section 114 generally includes pop-up hatch plate 122, pop-up section hinge 134, transparent armor panels 136, triangular shaped armored side panels 138, and pop-up section base plate 140. The pop-up section 114 has a generally trapezoidal shape. The base 140 of pop-up section 114 is attached to bolt-on plate 116 through pop-up section hinges 134. Pop-up section 114 would rotate about 13 degrees about pop-up section hinge 134.

Figure 20:
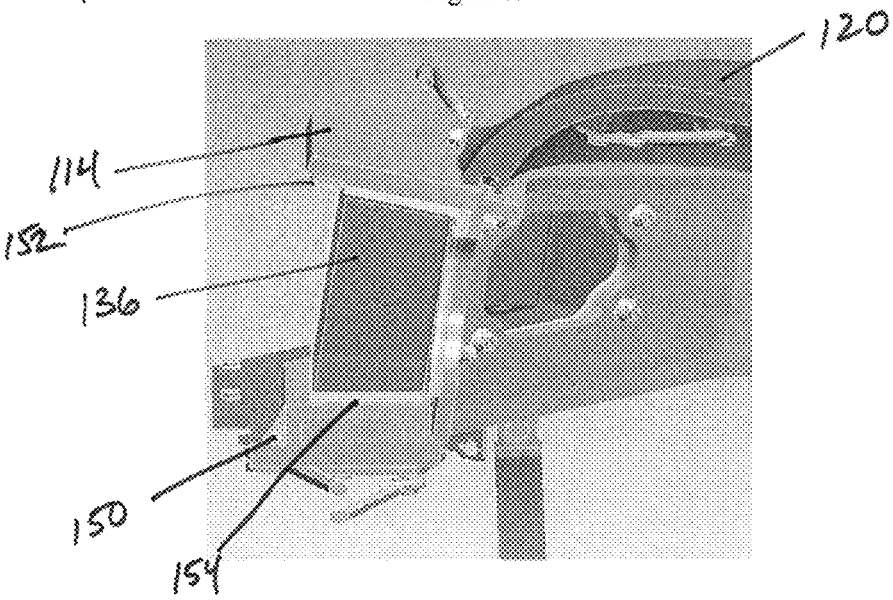
FIG. 20 is a cross sectional view of the pop-up section of FIG. 17 illustrating alternate seal placement.

With respect to the seals about the transparent armor windows 136 and pop-up section 114, the mid-section seal solution may include, as illustrated in FIG. 20: Wedge Shaped Bottom Seal design 150; Rectangle Shaped Top Seal 152; and Filler plate seal 154 under the windows 136.

In operation, raising the pop-up section 114 would require an operator to unlatch the pop-up section 114 through pop-up section latch 148. FIG. 19 illustrates the position of the latch 148 after rotating approximately 30 degrees to retract pop-up latch pins 150 from base plate receptors 149. Once unlatched, the operator would activate the actuator control 158 operably connected to an EHA or alternatively an electric worm gear lift mechanism. Preferably, actuator control 158 is mounted on pop-up latch 148

It is further envisioned that the present invention may include sensors to detect whether the hatch is open or closed and the configuration of the pop-up hatch. There may also be an indicator light provided to the COS providing the state of the hatch and pop-up configuration.

It is envisioned that the hatch design may be tailored to fit the geometry of many different vehicles, ships or stationary posts. Essentially, the driver's hatch design has utility wherever the need for protected viewing exists.

While the invention is amenable to various modifications and alternative forms, specifics thereof have been shown by way of example in the drawings and described in detail. It is understood, however, that the intention is not to limit the invention to the particular embodiments described. On the contrary, the intention is to cover all modifications, equivalents, and alternatives falling within the spirit and scope of the invention as defined by the appended claims.

The invention claimed is:

1. A driver's hatch for an armored vehicle, the driver's hatch including:

a dome hatch, a pop-up section that supports the dome hatch, an emergency hatch, said emergency hatch disposed within the dome hatch, and a bolt-on plate that mounts to the armored vehicle, said bolt-on plate defining an aperture in which the pop-up section is disposed.

2. The driver's hatch of claim 1 wherein the dome hatch defines a dome hatch aperture, for the emergency hatch to reside, said emergency hatch restrained in the dome hatch aperture by a plurality of locking pins.

3. The driver's hatch of claim 1 wherein the dome hatch is connected to a top plate of the pop-up section by a hinge.

4. The driver's hatch of claim 3 wherein the dome hatch is raised by operating a dome hatch latch.

5. The driver's hatch of claim 4 wherein the dome hatch latch further includes an indexing pin control so as to lock the dome hatch in a plurality of various preset positions.

6. The driver's hatch of claim 1 wherein a leading edge of the pop-up section rotates away from the bolt-on plate through pop-up section hinge.

7. The driver's hatch of claim 6 wherein pop-up section lift mechanism is used to rotate the pop-up section.

8. The driver's hatch of claim 7 wherein pop-up section lift mechanism is an electric hydraulic actuator.

9. The driver's hatch of claim 7 wherein pop-up section lift mechanism is an electric worm gear.

10. The driver's hatch of claim 7 wherein pop-up section lift mechanism is a manually operated jack.

11. The driver's hatch of claim 6 wherein the pop-up section has a trapeziodal shape and contains a plurality of transparent armored windows disposed about the leading edge of the pop-up section.

12. The driver's hatch of claim 11 wherein the pop-up section is sealed to the bolt-on plate by a flexible sealing ring.

13. The driver's hatch of claim 6 wherein the pop-up section includes a latch for locking the pop-up section in a retracted position.

* * * * *